US010211500B2

(12) United States Patent
Kwak

(10) Patent No.: US 10,211,500 B2
(45) Date of Patent: Feb. 19, 2019

(54) TUNABLE LOW-PASS FILTER USING DUAL MODE

(71) Applicant: Electronics and Telecommunications Research Institute, Daejeon (KR)

(72) Inventor: Changsoo Kwak, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 129 days.

(21) Appl. No.: 15/442,028

(22) Filed: Feb. 24, 2017

(65) Prior Publication Data

US 2018/0138571 A1 May 17, 2018

(30) Foreign Application Priority Data

Nov. 17, 2016 (KR) ..... 10-2016-0153339

(51) Int. Cl.
*H01P 1/207* (2006.01)
*H01P 7/06* (2006.01)
*H01P 1/208* (2006.01)

(52) U.S. Cl.
CPC ..... *H01P 1/207* (2013.01); *H01P 1/208* (2013.01); *H01P 1/2082* (2013.01); *H01P 7/06* (2013.01)

(58) Field of Classification Search
CPC ..... H01P 1/207; H01P 1/208; H01P 1/2082; H01P 1/2086; H01P 7/06
USPC ..... 333/208, 209, 212
See application file for complete search history.

(56) References Cited

U.S. PATENT DOCUMENTS 8,884,723 B2 11/2014 Yassini et al.
2011/0298566 A1* 12/2011 Yassini ..... H01P 7/06 333/202
2012/0049983 A1 3/2012 Uhm et al.
2012/0161905 A1 6/2012 Lee et al.
2017/0033424 A1 2/2017 Kwak et al.

FOREIGN PATENT DOCUMENTS

KR 100783360 B1 12/2007
KR 1020150112179 A 10/2015

OTHER PUBLICATIONS

Arnold, Christian et al., "Reconfigurable Waveguide Filter with Variable Bandwidth and Center Frequency", IEEE Transactions on Microwave Theory and Techniques, vol. 62, No. 8, pp. 1663-1670, Jul. 8, 2014, IEEE.
Kwak, Changsoo et al., "Study on slot irises for tunable filters using TE011 mode", Electronics Letters, Feb. 5, 2015, vol. 51, No. 3, pp. 266-268.
Yassini, Bahram et al., "A Ka-Band Fully Tunable Cavity Filter", IEEE Transactions on Microwave Theory and Techniques, vol. 60, No. 12, Nov. 16, 2012, pp. 4002-4012, IEEE.

* cited by examiner

*Primary Examiner* — Rakesh B Patel
(74) *Attorney, Agent, or Firm* — William Park & Associates Ltd.

(57) ABSTRACT

Disclosed is a tunable low-pass filter using a dual mode including a cylindrical cavity configured to trigger a resonant mode, a plurality of irises formed on a lateral face of the cylindrical cavity, and a dummy iris formed on the lateral face of the cylindrical cavity, wherein the resonant mode includes a plurality of modes having a plurality of resonant frequencies, and differences in resonance frequency between the plurality of modes are determined based on angles between the plurality of irises based on an axis of the cylindrical cavity.

6 Claims, 11 Drawing Sheets

TUNABLE LOW-PASS FILTER USING DUAL MODE

CROSS-REFERENCE TO RELATED APPLICATION(S)

This application claims the priority benefit of Korean Patent Application No. 10-2016-0153339 filed on Nov. 17, 2016, in the Korean Intellectual Property Office, the disclosure of which is incorporated herein by reference for all purposes.

BACKGROUND

1. Field

One or more example embodiments relate to a tunable low-pass filter using a dual mode.

2. Description of Related Art

A mechanically tunable filter implemented as a cavity resonator may have a high quality factor compared to other electrically tunable filters and thus, used when an insertion loss needs to be low. When the mechanically tunable filter is used for space/aviation, a size and a weight may be important and thus, efforts are needed to minimize the size and the weight.

In terms of a tunable filter, there is a case in which a center frequency varies, a case in which a bandwidth varies, and a case in which both center frequency and bandwidth vary. In a flexible system for maximizing a frequency use efficiency, a filter tunable in center frequency and bandwidth may be required.

SUMMARY

An aspect provides a low-pass filter tunable in center frequency while maintaining a filter characteristic in a wide frequency range.

Another aspect also provides a low-pass filter of which a size and a weight are reduced using a dual mode.

According to an aspect, there is provided a low-pass filter including a cylindrical cavity configured to trigger a resonant mode, a plurality of irises formed on a lateral face of the cylindrical cavity, and a dummy iris formed on the lateral face of the cylindrical cavity, wherein the resonant mode includes a plurality of modes having a plurality of resonant frequencies, and differences in resonance frequency between the plurality of modes are determined based on angles between the plurality of irises based on an axis of the cylindrical cavity.

The plurality of irises may be formed on the lateral face at a predetermined angle.

The plurality of irises may each have a length less than a half-wave length of a used frequency.

The low-pass filter may further include a piston configured to move in the cylindrical cavity, and a location of the piston may be adjusted to adjust a center frequency of the low-pass filter.

The resonant mode may be a transverse electric m1($TE_{m1}$) mode, and m is an integer.

The plurality of irises are formed at a position at which one electric field is zero, the dummy iris may be formed at a position at which other electric field is zero on the lateral face of the cylindrical cavity.

The low-pass filter may further include a tuning screw configured to compensate for a resonance frequency reduced by the dummy iris.

The tuning screw and the dummy iris may be formed on the cylindrical cavity at angles corresponding to multiples of 180/m degrees (°) based on the axis of the cylindrical cavity and a transverse electric m1($TE_{m1}$) mode, and wherein m is an integer.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Figure 1A:
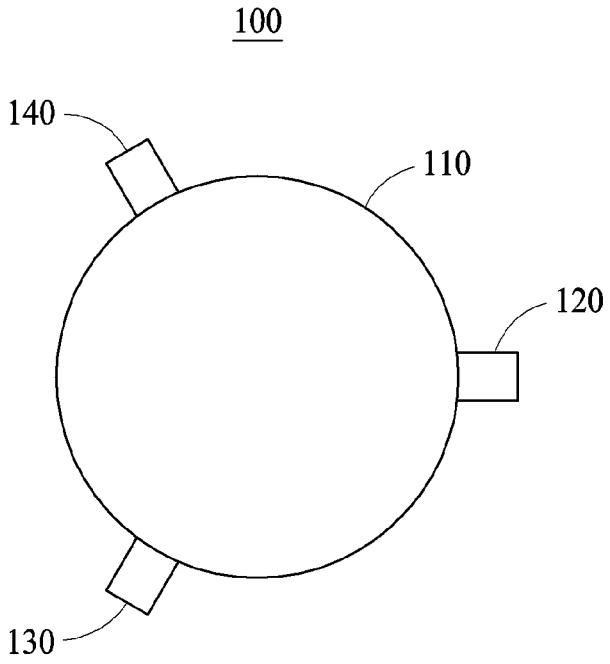
FIG. 1A is a top view illustrating a low-pass filter according to an example embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art. Various alterations and modifications may be made to the examples. Here, the examples are not construed as limited to the disclosure and should be understood to include all changes, equivalents, and replacements within the idea and the technical scope of the disclosure.

Terms such as first, second, A, B, (a), (b), and the like may be used herein to describe components. Each of these terminologies is not used to define an essence, order or sequence of a corresponding component but used merely to distinguish the corresponding component from other component(s). For example, a first component may be referred to a second component, and similarly the second component may also be referred to as the first component.

It should be noted that if it is described in the specification that one component is "connected," "coupled," or "joined" to another component, a third component may be "connected," "coupled," and "joined" between the first and second components, although the first component may be directly connected, coupled or joined to the second component. In addition, it should be noted that if it is described in the specification that one component is "directly connected" or "directly joined" to another component, a third component may not be present therebetween. Likewise, expressions, for example, "between" and "immediately between" and "adjacent to" and "immediately adjacent to" may also be construed as described in the foregoing.

The terminology used herein is for the purpose of describing particular embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms, including technical and scientific terms, used herein have the same meaning as commonly understood by one of ordinary skill in the art to which this disclosure pertains. Terms, such as those defined in commonly used dictionaries, are to be interpreted as having a meaning that is consistent with their meaning in the context of the relevant art, and are not to be interpreted in an idealized or overly formal sense unless expressly so defined herein.

Hereinafter, example embodiments will be described in detail with reference to the accompanying drawings, and like reference numerals in the drawings refer to like elements throughout.

Figure 1B:
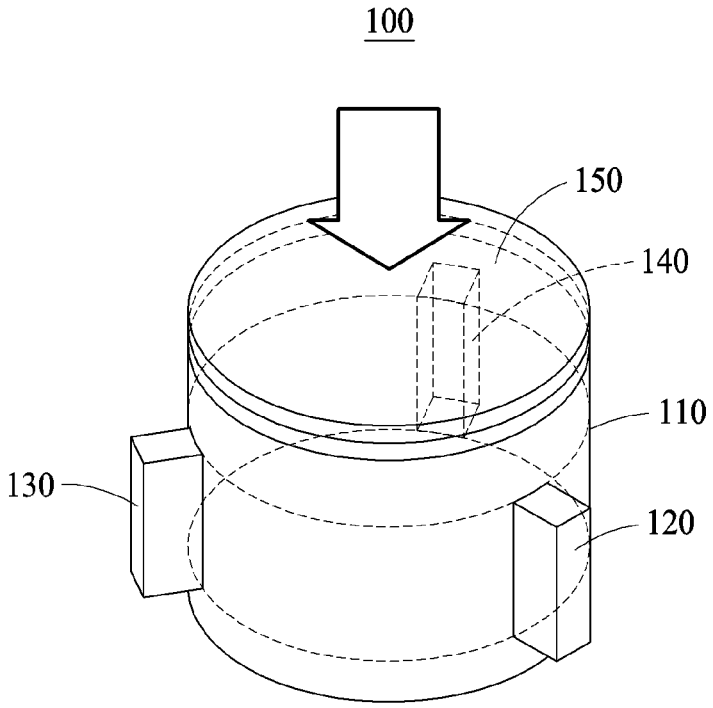
FIG. 1B is a perspective view of a low-pass filter according to an example embodiment.

FIG. 1A is a top view illustrating a low-pass filter according to an example embodiment, and FIG. 1B is a perspective view of a low-pass filter according to an example embodiment.

Referring to FIGS. 1A and 1B, a low-pass filter 100 may include a cylindrical cavity 110, a plurality of irises 120 and 130, a dummy iris 140, and a piston 150 to trigger a resonant mode.

The low-pass filter 100 may be a pseudo-low-pass filter.

A plurality of resonant modes having a plurality of resonant frequencies may occur in the cylindrical cavity 110. For example, a resonant mode may include a first mode having a first resonance frequency and a second mode having a second resonance frequency. The first mode and the second mode may be a transverse electric 21 ($TE_{21}$) mode. In this example, an electric field of the first mode may be orthogonal to an electric field of the second mode. The low-pass filter 100 corresponding to the pseudo-low-pass filter may minimize a weight and a size using a dual TE21 mode having a difference in resonance frequency.

A difference between the first resonance frequency and the second resonance frequency may be determined based on relative locations of the plurality of irises 120 and 130. For example, the difference between the first resonance frequency and the second resonance frequency may be determined based on an angle between the plurality of irises 120 and 130 relative to an axis of the cylindrical cavity 110. The difference between the first resonance frequency and the second resonance frequency may be maximized when the angle is zero degrees (°) and 180°, and the difference may be zero when the angle is 45°. The plurality of irises 120 and 130 may be formed on a lateral face of the cylindrical cavity 110 at a predetermined angle.

The low-pass filter 100 may be connected to an input port and an output port using the plurality of irises 120 and 130. A length of each of the plurality of irises 120 and 130 may be less than a half wave length of a frequency used by the low-pass filter 100. The lengths of the plurality of irises 120 and 130 may be identical to or different from each other. The plurality of irises 120 and 130 may be used as an input iris and an output iris. When the iris 120 is the input iris and the iris 130 is the output iris, the iris 120 may be connected to the input port and the iris 130 may be connected to the output port.

The input port and the output port may be reversed. When the iris 120 is the output iris and the iris 130 is the input iris, the iris 120 may be connected to the output port and the iris 130 may be connected to the input port.

The piston 150 may move in the cylindrical cavity 110. For example, a distribution of the electric field strength in the cylindrical cavity 110 may be changed in response to a change in location of the piston 150. The center frequency of the low-pass filter 100 may be changed in response to the cavity size being changed. Accordingly, the low-pass filter 100 may adjust the location of the piston 150 to adjust the center frequency.

The dummy iris 140 may minimize a difference between a variation in resonance frequency of the first mode and a variation in resonance frequency of the second mode based on the change in location of the piston 150. The dummy iris 140 may increase a tunable range of the low-pass filter 100 in the dual mode.

The dummy iris 140 may be formed between the plurality of irises 120 and 130 on the lateral face of the cylindrical cavity 110. For example, unlike the plurality of irises 120 and 130, the dummy iris 140 may be a dummy iris that does not perform input and output.

When the irises 120 and 130 are formed at a position at which one electric field is zero, the dummy iris 140 may be formed at a point at which other electric field is zero, on the lateral face of the cylindrical cavity 110. For example, the dummy iris 140 may be formed at a point at which the electric field formed in the second mode of the plurality of modes of the low-pass filter 100 is zero.

Figure 2A:
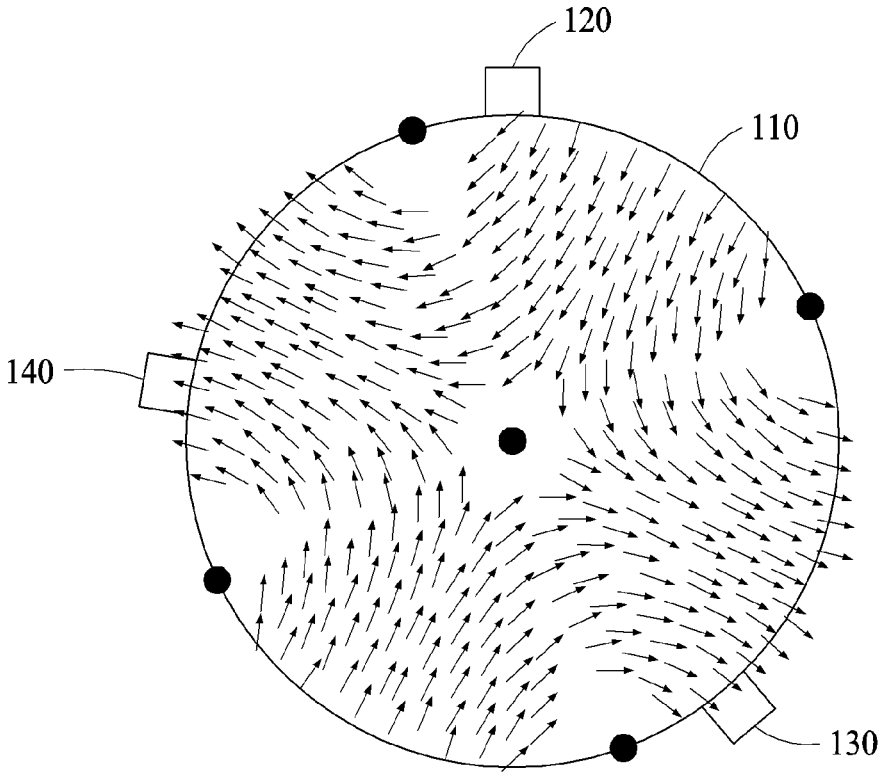
FIGS. 2A and 2B illustrate examples of a low-pass filter having an electric field in a plurality of modes according to an example embodiment.
Figure 2B:
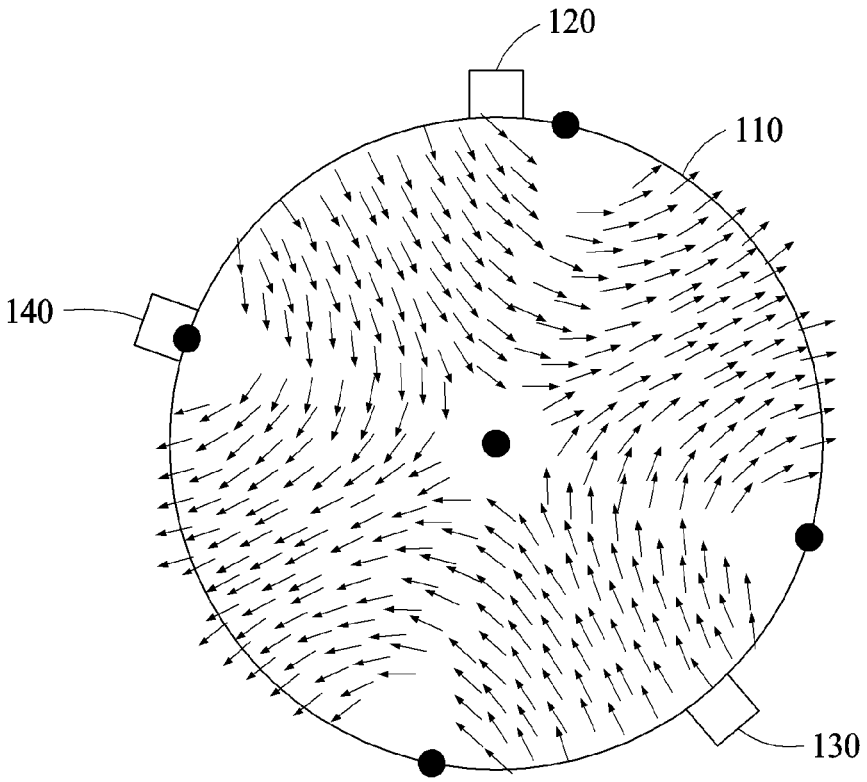
Figure 3A:
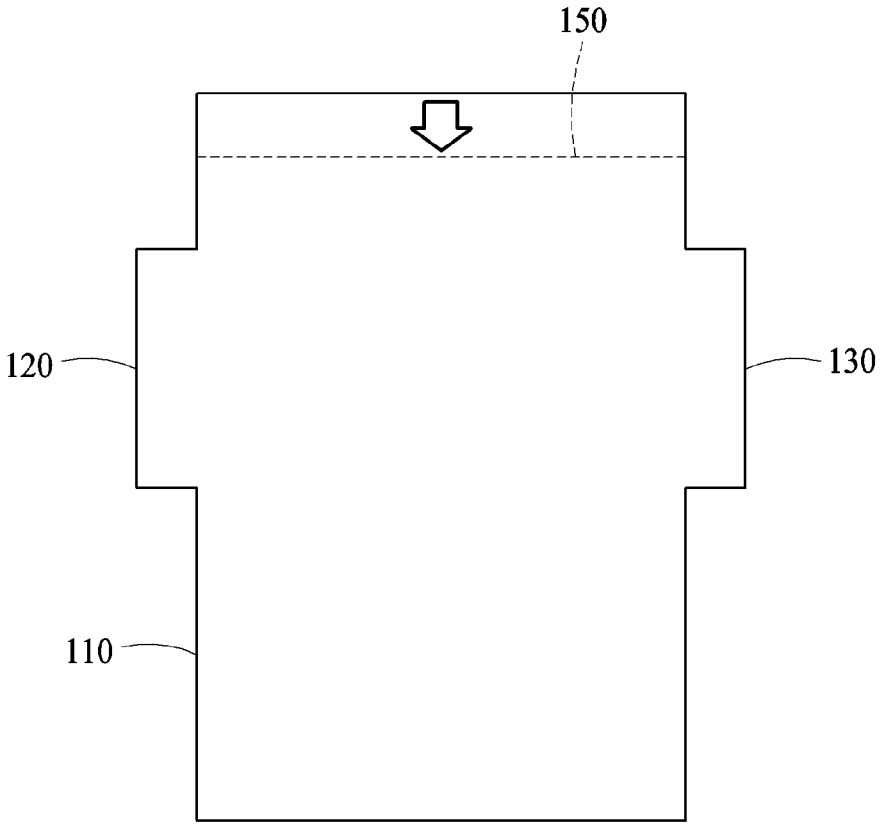
FIGS. 3A through 3C illustrate examples of a low-pass filter having an electric field varying based on a height of a piston according to an example embodiment.
Figure 3B:
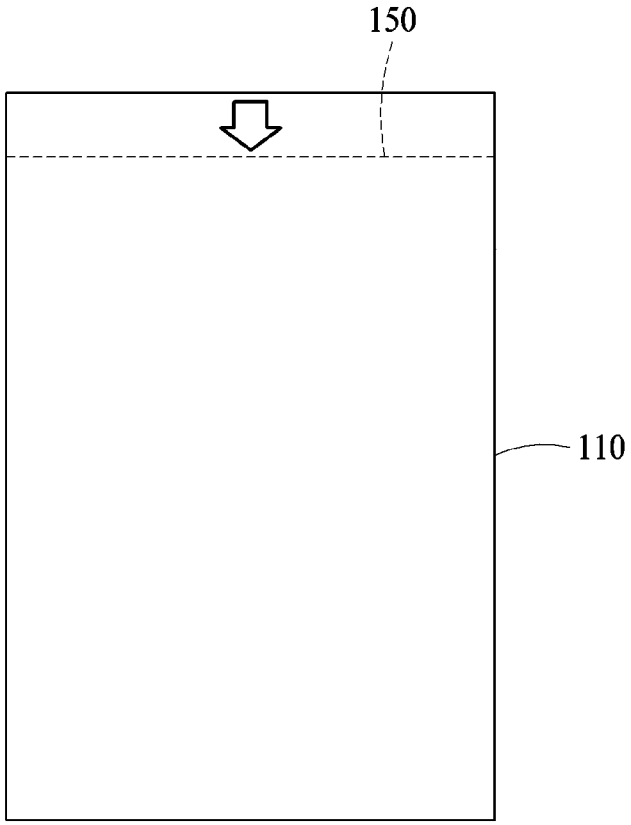
Figure 3C:
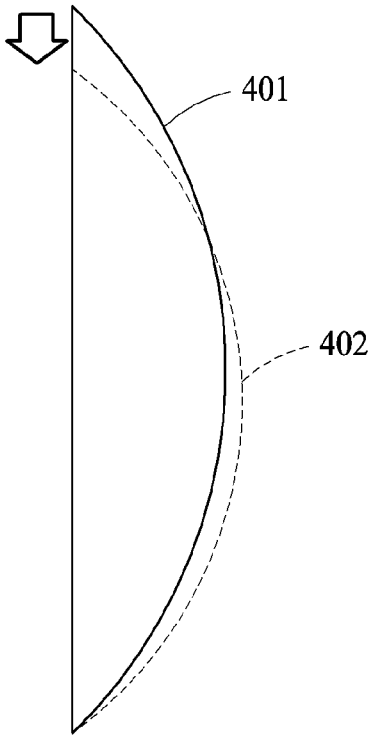

FIGS. 2A and 2B illustrate examples of a low-pass filter having an electric field in a plurality of modes according to an example embodiment, and FIGS. 3A through 3C illustrate examples of a low-pass filter having an electric field varying based on a height of a piston according to an example embodiment.

Referring to FIGS. 2A through 3B, in the low-pass filter 100, a difference between a plurality of resonant frequencies may be determined based on relative locations of the plurality of irises 120 and 130 and a plurality of modes having the plurality of resonant frequencies may be formed.

In the low-pass filter 100, a first mode and a second mode having a first resonance frequency and a second resonance frequency differing from each other may be formed based on the relative locations of the plurality of irises 120 and 130. An example of an electric field in the first mode may be as illustrated in FIG. 2A. An example of an electric field in the second mode may be illustrated in FIG. 2B.

The first mode may be a resonant mode based on the first resonance frequency, for example, 20.35 gigahertz (GHz). The second mode may be a resonant mode based on the second resonance frequency, for example, 20.45 GHz.

In FIG. 2A, a plurality of points on the cylindrical cavity 110 may correspond to points at which an intensity of an electric field is zero in the first mode. In FIG. 2B, a plurality of points on the cylindrical cavity 110 may correspond to points at which an intensity of an electric field is zero in the second mode. As illustrated in FIGS. 2A and 2B, the points at which the electric field is zero in the first mode are closer to the plurality of irises 120 and 130 when compared to the points at which the electric field is zero in the second mode. In this example, a resonance frequency of the first mode to which a space for an iris is added may be less than a resonance frequency of the second mode to which the space is not added.

Cross sections of the cylindrical cavity 110 corresponding to the first mode and the second mode may be as illustrated in FIGS. 3A and 3B. A distribution of an intensity of an electric field varying based on a height of the piston 150 in the low-pass filter 100 may be as illustrated in FIG. 3C.

For example, FIG. 3A illustrates a cross section of the cylindrical cavity 110 on which the electric field of the first mode is distributed, and FIG. 3B illustrates a cross section of the cylindrical cavity 110 on which the electric field of the second mode is distributed. FIGS. 3A and 3B are side cross-sectional views of the cylindrical cavity 110.

As illustrated in FIG. 3C, when the piston 150 descends, an intensity of an electric field may be changed from a first electric field 401 to a second electric field 402. When compared to the first electric field 401, the second electric field 402 may have a greater a maximum value of the intensity of the electric field. Also, a location corresponding to the maximum value may be lower than that of the first electric field 401.

Since a space for the electric field in the first mode and a space for the electric field in the second mode are different in shape, the resonance frequency of the first mode and the resonance frequency of the second mode may be differently changed in response to the change in location of the piston 150. In this example, the dummy iris 140 may be formed on the cylindrical cavity 110 such that the second mode is also affected by an iris. Through this, the resonance frequency of the first mode and the resonance frequency of the second mode may be similarly changed. For example, the dummy iris 140 may be formed at a point at which the intensity of the electric field is zero in the second mode, on the cylindrical cavity 110. Similarly to the electric field of the first mode being affected by the plurality of irises 120 and 130, the electric field of the second mode may also be affected by an iris, for example, the dummy iris 140. The low-pass filter 100 may increase a tunable range using the dummy iris 140 without deterioration of original performance.

Figure 4A:
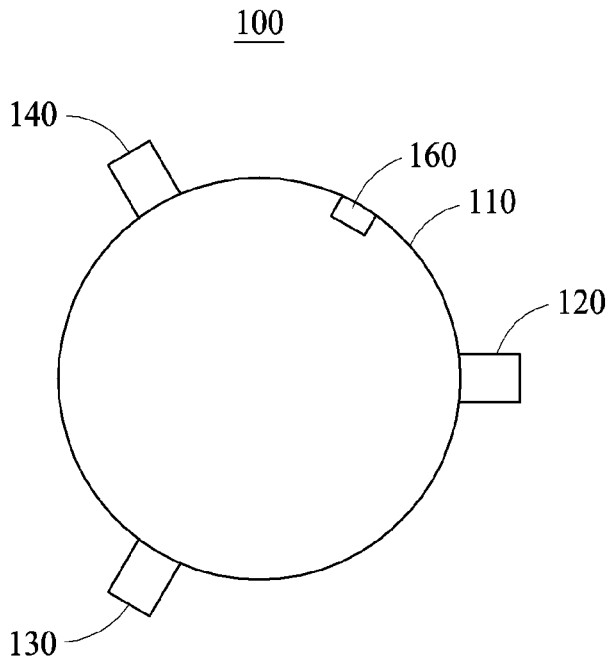
FIG. 4A illustrates an example of the low-pass filter of FIG. 1.
Figure 4B:
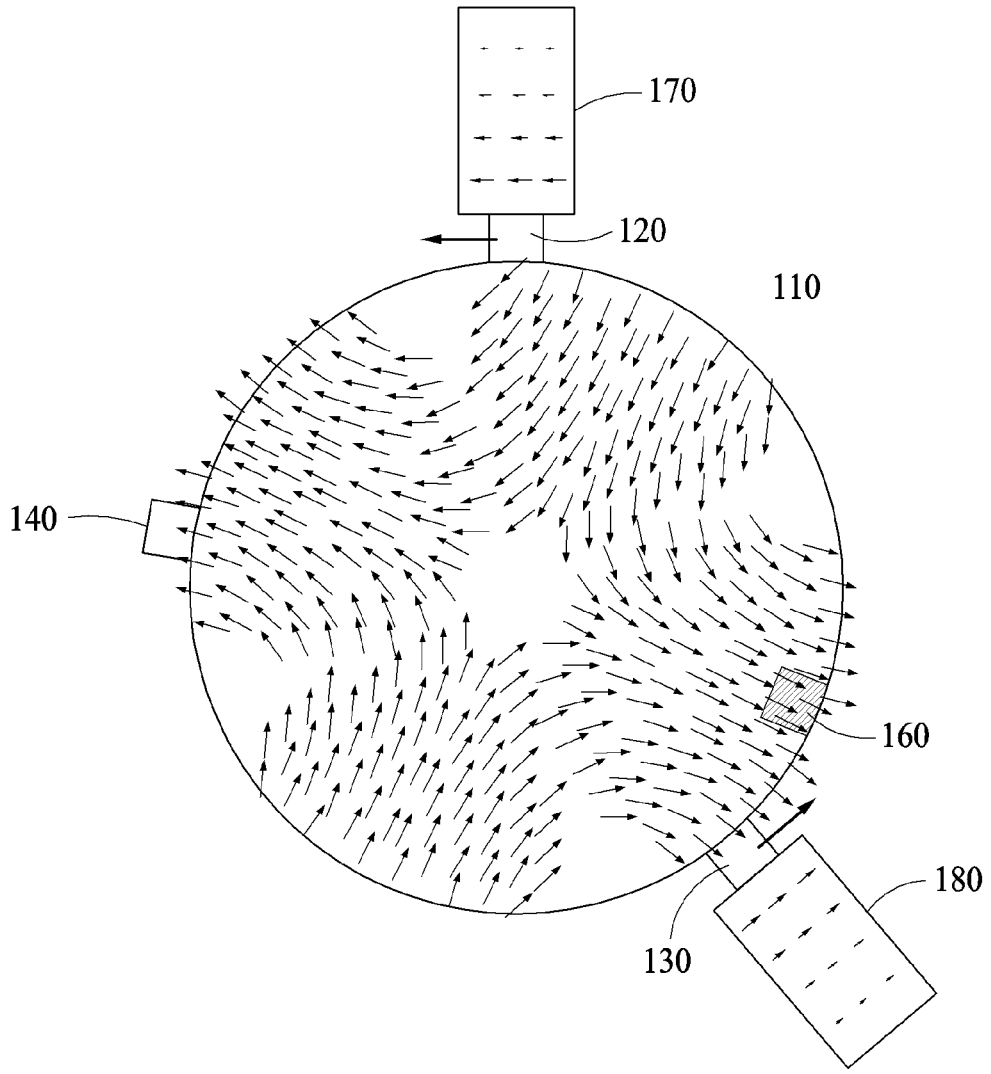
FIGS. 4B and 4C illustrate examples of the low-pass filter having an electric field in a plurality of modes of FIG. 4A.
Figure 4C:
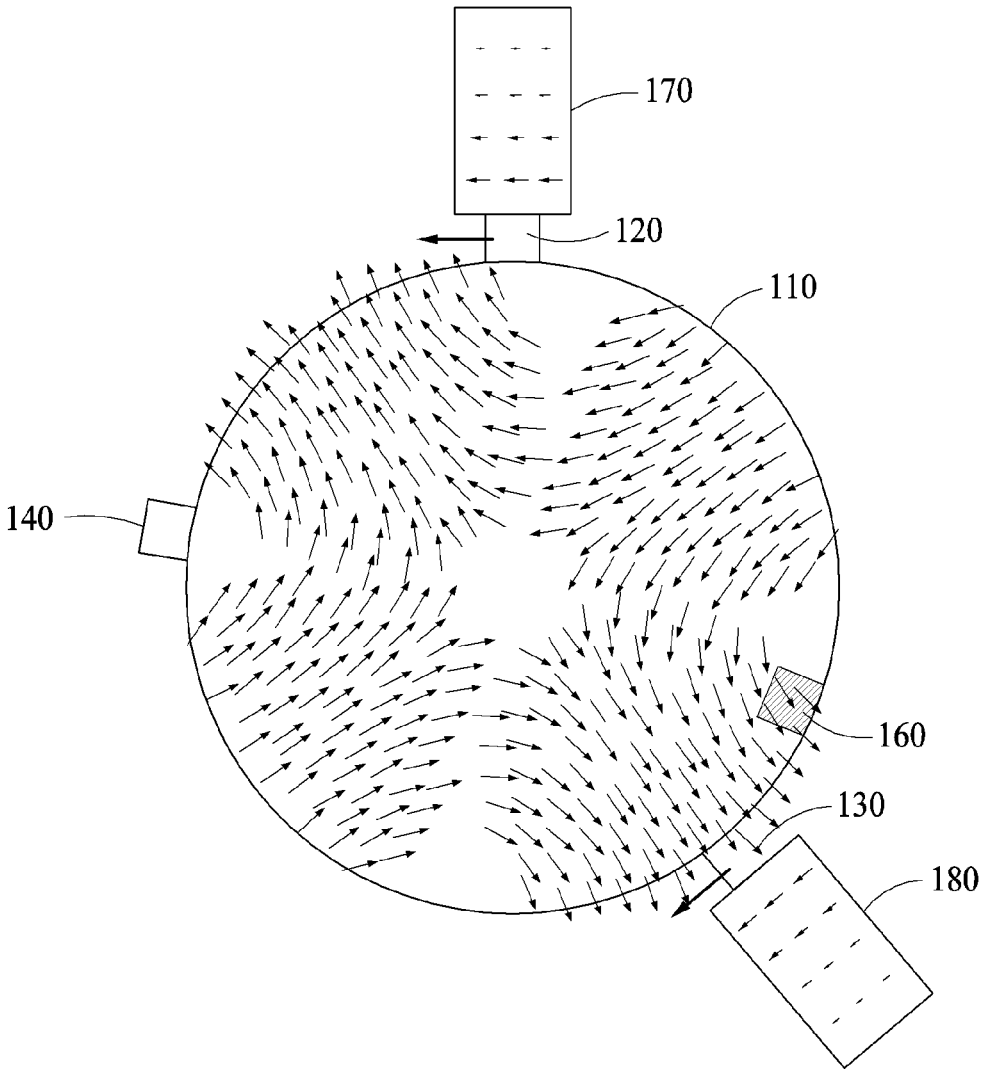

FIG. 4A illustrates an example of the low-pass filter of FIG. 1, and FIGS. 4B and 4C illustrate examples of the low-pass filter having an electric field in a plurality of modes of FIG. 4A Referring to FIGS. 4A through 4C, the low-pass filter 100 may include the cylindrical cavity 110, the plurality of irises 120 and 130, the input and output ports 170 and 180 as seen in FIGS. 4B and 4C, the dummy iris 140, and a piston (not shown). The low-pass filter 100 may further include a tuning screw 160.

In an example of FIG. 4A, configurations and operations of the cylindrical cavity 110, the plurality of irises 120 and 130, the dummy iris 140, and the piston may be substantially the same as the configurations and operations of the cylindrical cavity 110, the plurality of irises 120 and 130, the dummy iris 140, and the piston 150 as described with reference to FIGS. 1A and 1B.

As the foregoing, the dummy iris 140 may be formed at a point at which an intensity of an electric field is zero in a second mode, on the cylindrical cavity 110 to obtain similar changes in resonance frequencies of a first mode and the second mode. In this example, in a state in which locations, for example, relative locations of the plurality of irises 120 and 130 are adjusted to obtain a desired difference in the plural resonant frequencies, the dummy iris 140 may be provided, which provides additional space for the second mode, and thus, the resonance frequency may be reduced. Accordingly, the dummy iris 140 may reduce the resonance frequency of the second mode.

The tuning screw 160 may compensate for the reduced resonance frequency. For example, the tuning screw 160 may increase the resonance frequency. The tuning screw 160 and the dummy iris 140 may be formed to have an included angle corresponding to a multiple of 90° based on an axis of the cylindrical cavity 110.

The tuning screw 160 may be used to restore the resonance frequency reduced due to the dummy iris 140, and also provided in various forms as well as a form of tuning screw. Also, the tuning screw 160 may be implemented in a structure that does not change a distribution of an electric field in a resonant mode, for example, a TE21 mode. In other words, the tuning screw 160 may be provided in a form that insignificantly changes the distribution of the electric field in the resonant mode, for example, the TE21 mode.

Since the descriptions of FIGS. 1A through 3C are also applicable here, repeated descriptions with respect to FIGS. 4A through 4C will be omitted.

Figure 5:
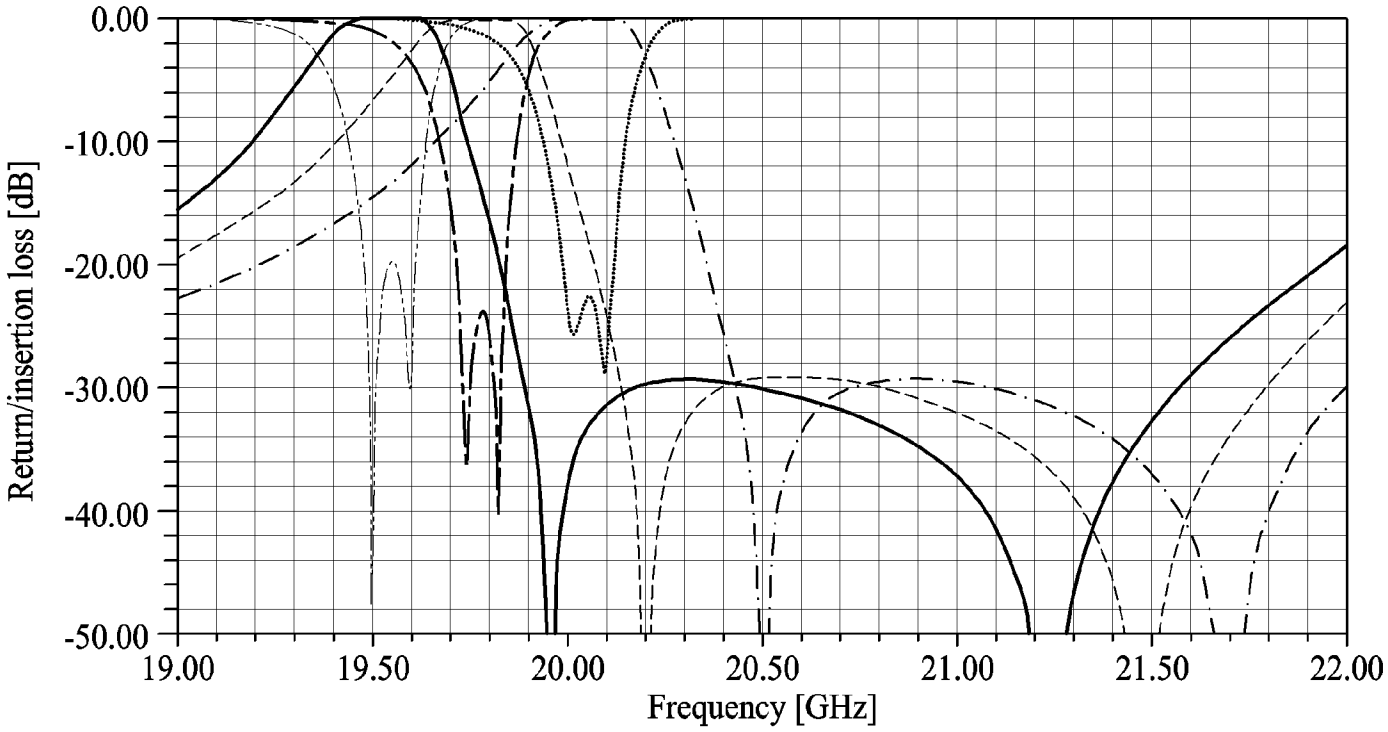
FIG. 5 is a graph illustrating a tunable characteristic of a low-pass filter according to an example embodiment.

FIG. 5 is a graph illustrating a tunable characteristic of a low-pass filter according to an example embodiment.

A tunable characteristic of the low-pass filter 100 may be shown with reference to FIG. 5. In FIG. 5, an x axis represents a frequency in a unit of GHz, and a y axis represents a return/insertion loss.

Specifically, it can be known that a performance of a filter is maintained while a frequency varies in a range of about 500 megahertz (MHz).

The components described in the exemplary embodiments of the present invention may be achieved by hardware components including at least one DSP (Digital Signal Processor), a processor, a controller, an ASIC (Application Specific Integrated Circuit), a programmable logic element such as an FPGA (Field Programmable Gate Array), other electronic devices, and combinations thereof. At least some of the functions or the processes described in the exemplary embodiments of the present invention may be achieved by software, and the software may be recorded on a recording medium. The components, the functions, and the processes described in the exemplary embodiments of the present invention may be achieved by a combination of hardware and software.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A low-pass filter comprising:

a cylindrical cavity configured to trigger a resonant mode;

a plurality of irises formed on a lateral face of the cylindrical cavity; and a dummy iris formed on the lateral face of the cylindrical, and a piston configured to move in the cylindrical cavity, wherein a location of the piston is adjusted to adjust a center frequency of the low-pass filter, wherein the resonant mode includes a plurality of modes having a plurality of resonant frequencies, and differences in resonance frequency between the plurality of modes are determined based on angles between the plurality of irises based on an axis of the cylindrical cavity, wherein the plurality of irises are formed at a point at which one electric field is zero, and wherein the dummy iris is formed at a position at which an other electric field is zero on the lateral face of the cylindrical cavity.

2. The low-pass filter of claim 1, wherein the plurality of irises is formed on the lateral face at a predetermined angle.

3. The low-pass filter of claim 1, wherein the plurality of irises each has a length less than a half-wave length of a used frequency.

4. The low-pass filter of claim 1, wherein the resonant mode is a transverse electric m1 ($TE_{m1}$) mode, and wherein m is an integer.

5. The low-pass filter of claim 1, further comprising: a tuning screw configured to compensate for a resonance frequency reduced by the dummy iris.

6. The low-pass filter of claim 5, wherein the tuning screw and the dummy iris are formed on the cylindrical cavity at angles corresponding to multiples of 180/m degrees (°) based on the axis of the cylindrical cavity and a transverse electric m1 ($TE_{m1}$) mode, and wherein m is an integer.

* * * * *